US011146015B2

(12) United States Patent
Wang et al.

(10) Patent No.: US 11,146,015 B2
(45) Date of Patent: Oct. 12, 2021

(54) COAXIAL CONNECTOR MANUFACTURED WITH MINIMUM PROTECTIVE METAL COATING TREATMENT

(71) Applicant: Molex, LLC, Lisle, IL (US)

(72) Inventors: Zhi-Qiang Wang, Shanghai (CN); Hao Yin, Shanghai (CN); Wei Yao, Shanghai (CN)

(73) Assignee: Molex, LLC, Lisle, IL (US)

( * ) Notice: Subject to any disclaimer, the term of this patent is extended or adjusted under 35 U.S.C. 154(b) by 87 days.

(21) Appl. No.: 16/599,137

(22) Filed: Oct. 11, 2019

(65) Prior Publication Data

US 2020/0119483 A1 Apr. 16, 2020

(30) Foreign Application Priority Data

Oct. 12, 2018 (CN) ..... 201821662765.1

(51) Int. Cl.
*H01R 13/502* (2006.01)

(52) U.S. Cl.
CPC ..... *H01R 13/502* (2013.01)

(58) Field of Classification Search
CPC ..... H01R 13/502
(Continued)

(56) References Cited

U.S. PATENT DOCUMENTS 5,595,499 A * 1/1997 Zander ..... H01R 13/6277 439/352
6,705,875 B2 * 3/2004 Berghorn ..... H01R 13/6315 439/252
(Continued)

FOREIGN PATENT DOCUMENTS

CN 102842791 B 8/2016
JP H07-169536 A 7/1995
(Continued)

OTHER PUBLICATIONS

Office action received for JP application No. 2019-187931, dated Nov. 10, 2020, 8 pages. (4 pages of English translation and 4 pages of official copy).
(Continued)

*Primary Examiner* — Peter G Leigh

(57) ABSTRACT

The present utility model discloses a coaxial connector, including a metal casing, an insulation body, and a central terminal. The metal casing includes a housing surrounding a central shaft to define an accommodation space, and a plurality of contact arms connected to the housing. The housing has a front housing surface and a rear housing surface. The rear housing surface has a non-antioxidation-treated surface portion. The contact arms are connected to the front housing surface. The insulation body surrounds the central shaft to define a positioning hole, and includes a front end surface, a rear end surface, an insertion slot recessed from the rear end surface and in communication with the positioning hole, and a wall covering portion extending radially from a position near the rear end surface to cover part of the non-antioxidation-treated surface portion. A central terminal passes through the positioning hole and includes a first contact end portion adjacent to the contact arms and a second contact end portion located at the insertion slot.

18 Claims, 13 Drawing Sheets

(58) Field of Classification Search
USPC ..... 439/578
See application file for complete search history.

(56) References Cited

U.S. PATENT DOCUMENTS

| | | | | |
|---|---|---|---|---|
| 8,801,459 | B2 * | 8/2014 | Mrowka | H01R 24/54 439/578 |
| 8,888,519 | B2 * | 11/2014 | Baumler | H01R 31/06 439/248 |
| 9,190,786 | B1 * | 11/2015 | Baumler | H01R 24/542 |
| 2002/0061670 | A1 | 5/2002 | Havener et al. | |
| 2013/0017739 | A1 * | 1/2013 | Glick | H01R 13/187 439/842 |
| 2014/0329399 | A1 * | 11/2014 | Ohsumi | H01R 13/5202 439/276 |
| 2016/0190721 | A1 | 6/2016 | Regantini et al. | |
| 2017/0244196 | A1 * | 8/2017 | Ilie | H01R 13/111 |

FOREIGN PATENT DOCUMENTS

| | | | | |
|---|---|---|---|---|
| JP | H09-129321 | A | 5/1997 | |
| JP | H09129321 | * | 5/1997 | H01R 13/627 |
| JP | 2001-093629 | * | 4/2001 | H01R 24/00 |
| JP | 2001-093629 | A | 4/2001 | |
| JP | 2015-170515 | A | 9/2015 | |
| JP | 6039541 | B2 | 12/2016 | |
| WO | 2018/226381 | A1 | 12/2018 | |

OTHER PUBLICATIONS

International Search report and written opinion received for PCT application No. PCT/US2018/033230, dated Sep. 14, 2018, 7 pages.
International preliminary report on Patentability received for PCT application No. PCT/US2018/033230, dated Dec. 19, 2019, 6 pages.

* cited by examiner

COAXIAL CONNECTOR MANUFACTURED WITH MINIMUM PROTECTIVE METAL COATING TREATMENT

TECHNICAL FIELD

This application claims priority to Chinese Application No. 201821662765.1, filed on Oct. 12, 2018, which is incorporated herein by reference in its entirety.

BACKGROUND

Chinese Patent Publication No. CN 102842791 B discloses a prior art electrical connector including an interface housing, a rear housing, and a connector subassembly. The connector subassembly is a coaxial connector, and includes an outer contact, a dielectric insert, and a central contact. The outer contact is formed on a carrier strip by stamping and is removed from the carrier strip before being combined with the dielectric insert and the central contact. Usually, the outer contact is subjected to antioxidation treatment during the stamping process. However, when the outer contact is separated from the carrier strip, a cut surface is formed on the outer contact, and the cut surface is not subjected to further antioxidation treatment. When the outer contact is copper or a copper alloy, the cut surface is liable to patina formation due to oxidation. Although it does not result in functional damage, the overall aesthetic appearance of the connector subassembly is affected. When antioxidation treatment has to be performed again, additional time and labor are consumed, and the manufacturing costs are increased.

SUMMARY

Accordingly, one of the objectives of the present utility model is to provide a coaxial connector not requiring additional antioxidation treatment.

Thus, in some embodiments, the coaxial connector of the present utility model has a central shaft and comprises a metal casing, an insulation body, and a central terminal. The metal casing comprises a casing surrounding the central shaft to define an accommodation space, and a plurality of contact arms connected to the casing. The housing has a front housing surface and a rear housing surface. The rear housing surface has a non-antioxidation-treated surface portion, and the plurality of contact arms are connected to the front housing surface and surround the central shaft in a manner spaced apart from each other. The insulation body is disposed in the accommodation space and surrounds the central shaft to define a positioning hole. The insulation body comprises a front end surface, a rear end surface, an insertion slot recessed from the rear end surface, along the central shaft, and toward the front end surface and in communication with the positioning hole, and a wall covering portion extending radially from a position near the rear end surface to cover the non-antioxidation-treated surface portion. The central terminal passes through the positioning hole and comprises a first contact end portion adjacent to the plurality of contact arms and a second contact end portion located at the insertion slot.

In some embodiments, the non-antioxidation-treated surface portion is formed by removing a strip.

In some embodiments, the housing further comprises a notch; the non-antioxidation-treated surface portion is located in the notch; the wall covering portion extends into the notch and covers the non-antioxidation-treated surface portion.

In some embodiments, the contour of the wall covering portion matches the contour of the notch.

In some embodiments, the housing further comprises a connecting arm portion extending backward with a tapered width located at the notch; the non-antioxidation-treated surface portion is a free end surface of the connecting arm portion; the wall covering portion forms a receiving cavity for the connecting arm portion to enter, causing the non-antioxidant treated surface portion to be located in the receiving cavity.

In some embodiments, the receiving cavity is formed on the same side as the wall covering portion and the front end surface.

In some embodiments, the connecting arm portion is provided with an upper surface portion inclined toward the central shaft and adapted to abut the wall covering portion.

In some embodiments, the wall covering portion is flush with the rear end surface.

In some embodiments, each of the contact arms has an extension portion extending forward from the front housing surface and a bent portion extending forward from the extension portion.

In some embodiments, the metal casing is made from copper or a copper alloy.

The present utility model has at least the following effects: the wall covering portion, which is formed on the insulation body near the rear end surface, covers the non-antioxidation-treated surface portion formed when the metal casing is separated from the strip. The non-antioxidation-treated surface portion thus does not need to be subjected to additional antioxidation treatment. Even if the non-antioxidation-treated surface portion is oxidized and a patina is formed, the patina would be hidden, and the aesthetic appearance would not be affected. Process steps are reduced, thereby saving manufacturing costs and time.

BRIEF DESCRIPTION OF THE DRAWINGS

Other features and effects of the present utility model will be apparent from the embodiments of the accompanying drawings in which.

DETAILED DESCRIPTION OF THE PREFERRED EMBODIMENTS

Figure 1:
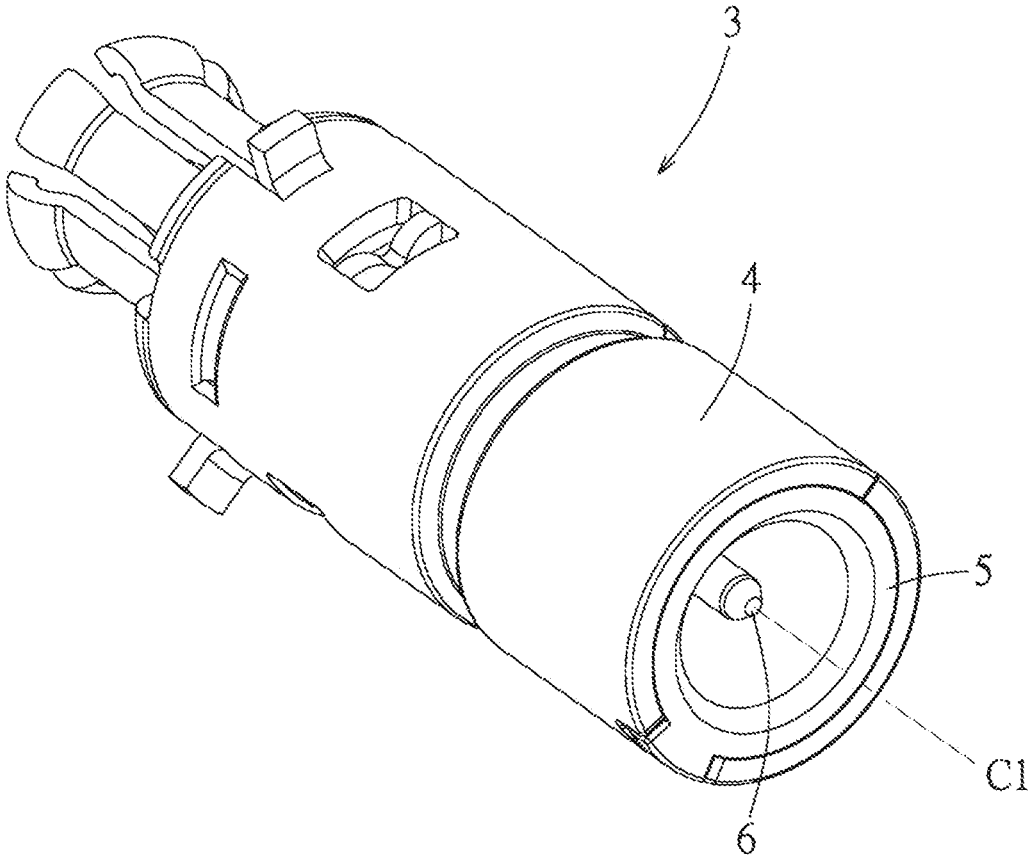
FIG. 1 is a perspective view of an embodiment of a coaxial connector of the present utility model.
Figure 2:
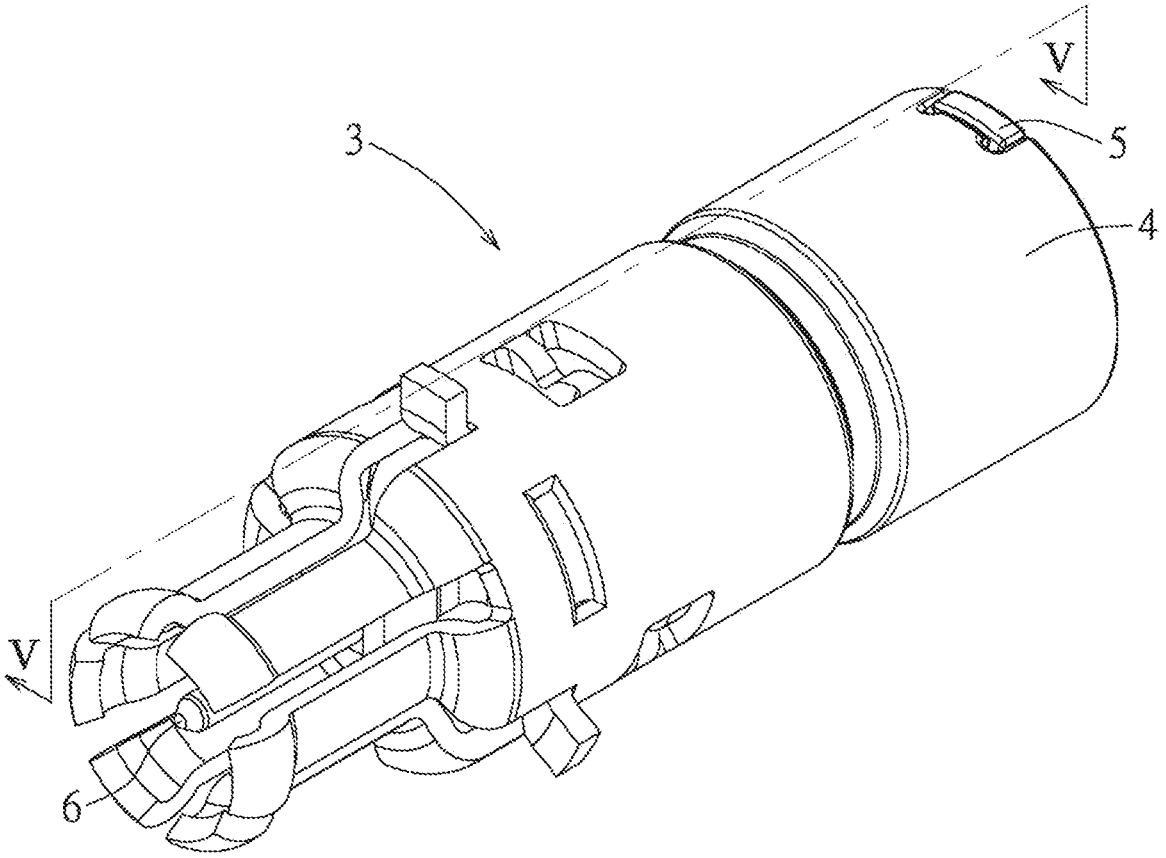
FIG. 2 is a perspective view of FIG. 1 from another angle.

Please refer to FIGS. 1 and 2. An embodiment of a coaxial connector 3 of the present utility model has a central shaft C1, and includes a metal casing 4, an insulation body 5, and a central terminal 6.

Figure 3:
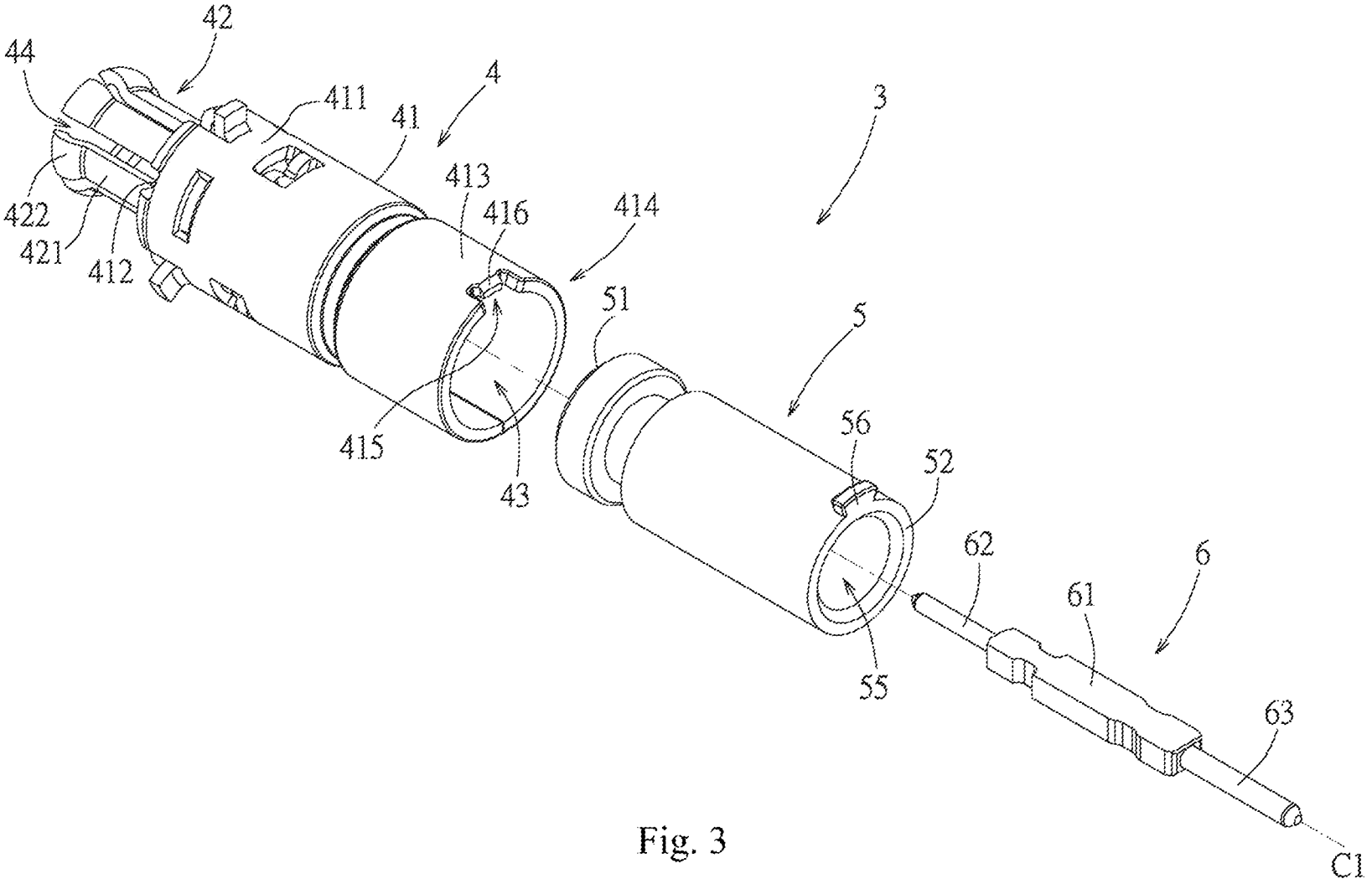
FIG. 3 is an exploded perspective view of this embodiment.
Figure 4:
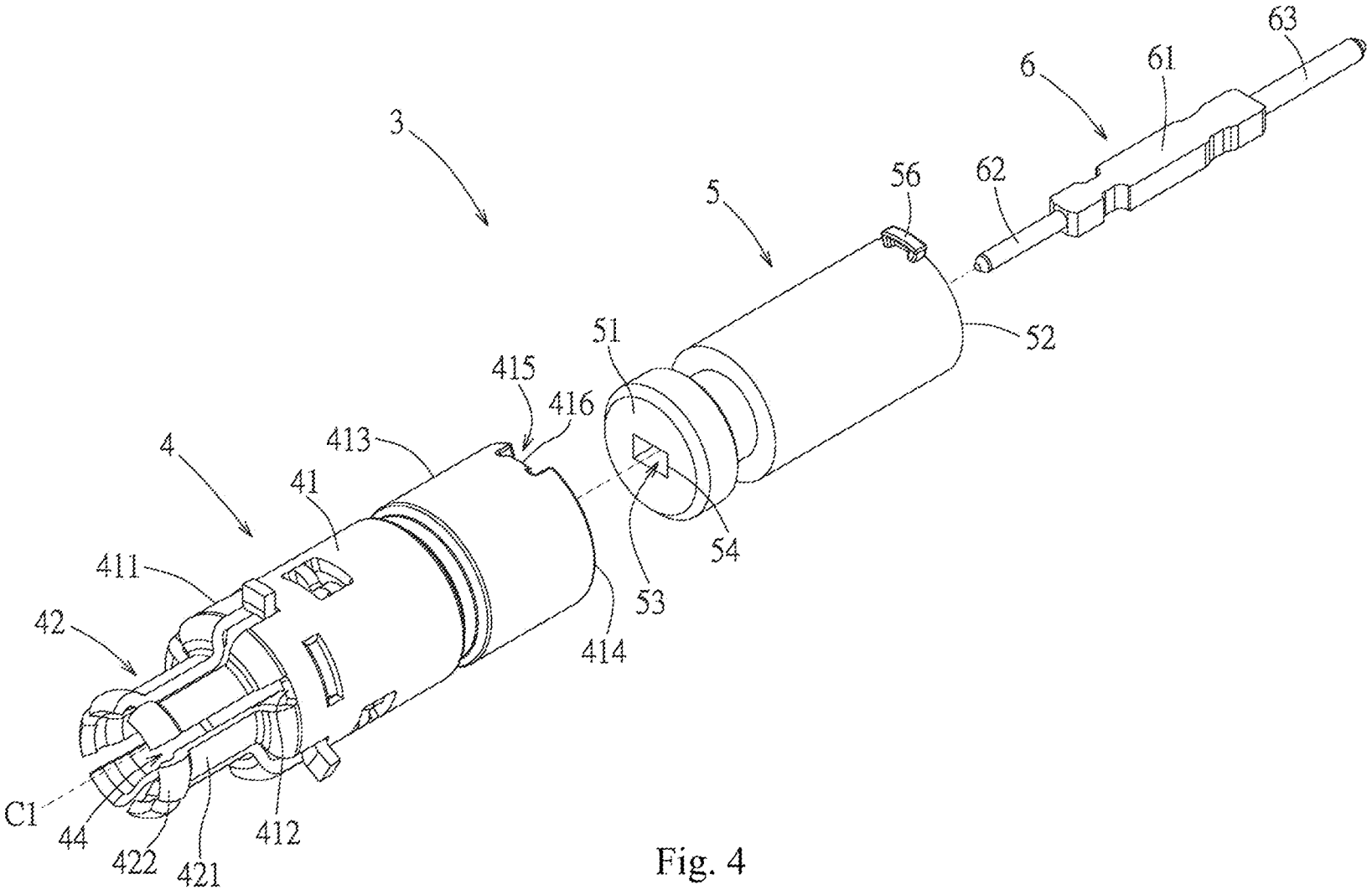
FIG. 4 is an exploded perspective view of FIG. 3 from another angle.
Figure 5:
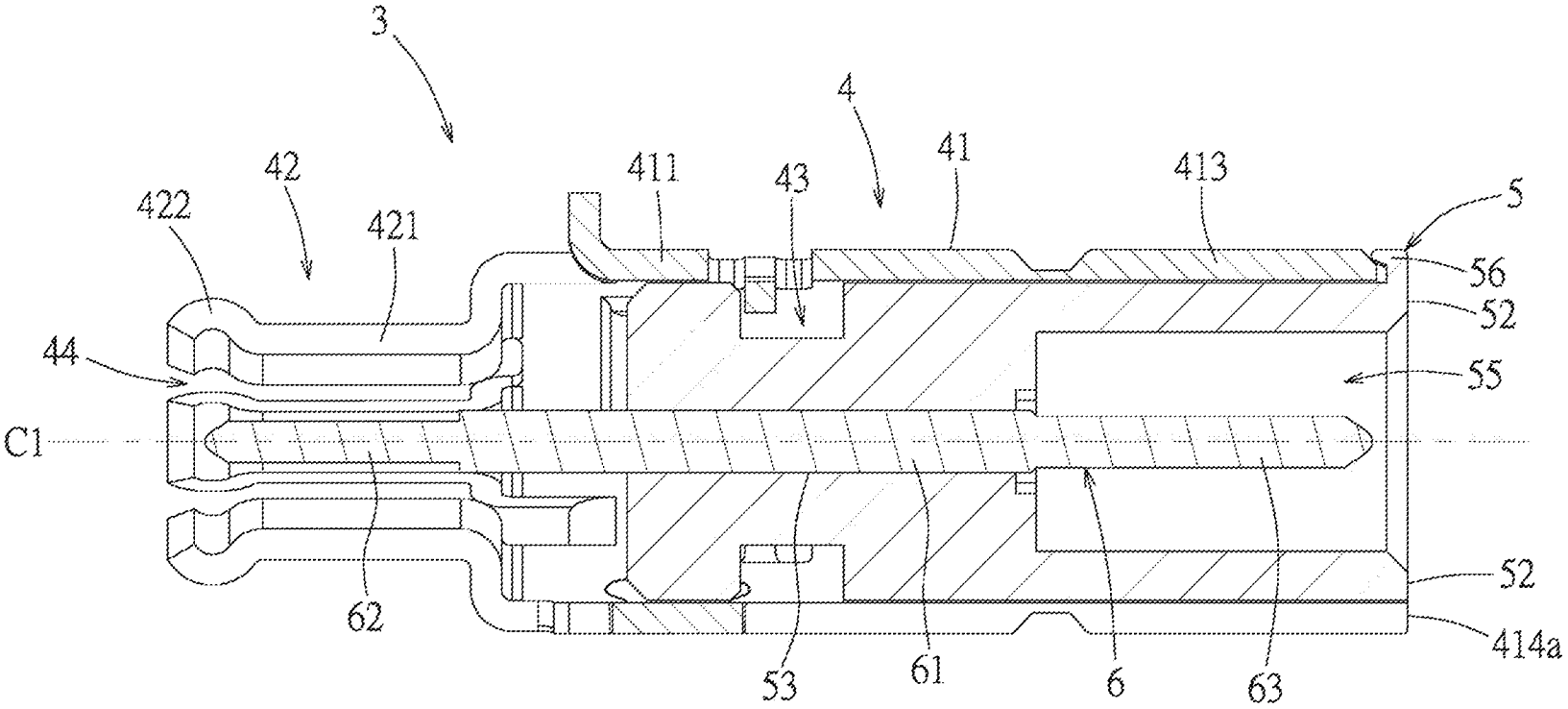
FIG. 5 is a cross-sectional view of FIG. 2 taken along line VV.

Please refer to FIGS. 3 to 5. The metal casing 4 includes a housing 41 and six contact arms 42 connected to the housing 41. The housing 41 has a cylindrical shape and surrounds the central shaft C1 to define an accommodation space 43. The housing 41 has a front end portion 411, a front housing surface 412 located at the front end portion 411 and surrounding the central shaft C1 while facing forward, a rear end portion 413 connected to the front end portion 411 and extending backward, a rear housing surface 414 located at the rear end portion 413 and surrounding the central shaft C1 while facing backward, a notch 415 at an end edge of the rear end portion 413, and a connecting arm portion 416 located at the notch 415. The six contact arms 42 are connected to the front housing surface 412 and surround the central shaft C1 in a manner spaced apart from each other, such that a slit 44 is formed between each two contact arms 42. Each contact arm 42 has an extension portion 421 connected to the front housing surface 412 and a bent portion 422 connected to the extension portion 421. Each of the extension portions 421 is, for a small section, bent inwards from the front housing surface 412 toward a direction perpendicular to the central shaft C1, then bent forward in a direction parallel to the central shaft C1 and extends forward. Each of the bent portions 422 is connected to a front end of each of the extension portions 421, and is bent outward radially toward the front end portion 411 so as to be bent by an angle.

Figure 6:
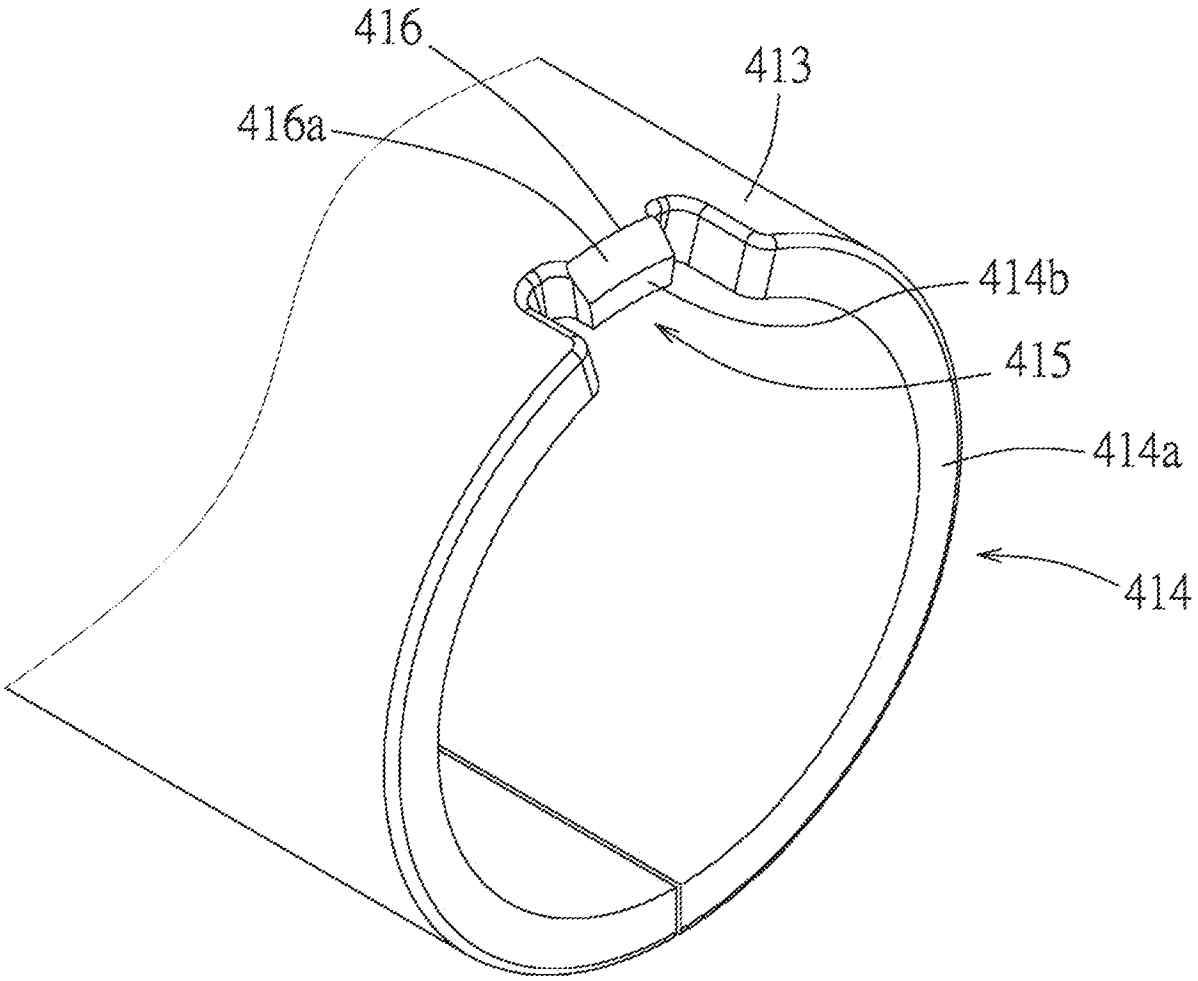
FIG. 6 is a partial enlarged view of FIG. 3.
Figure 7:
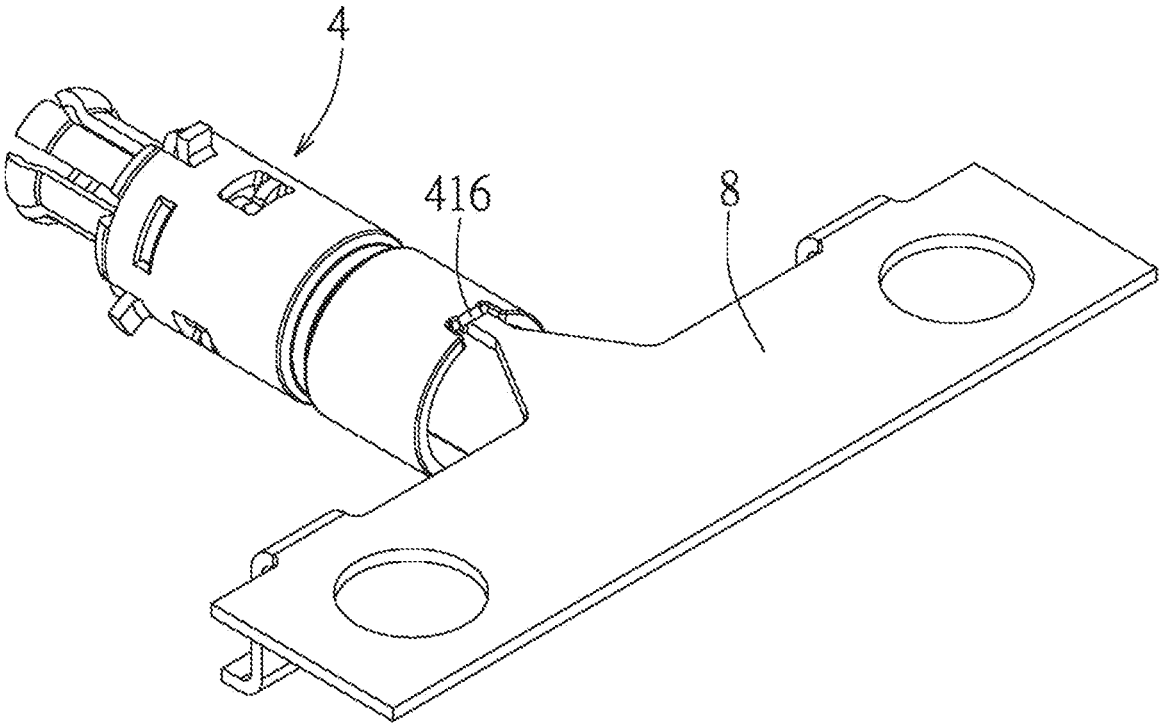
FIG. 7 is a perspective view of a metal casing of this embodiment connected to a strip.

Please refer further to FIG. 6 and FIG. 7. The rear housing surface 414 has a main surface portion 414*a* formed by an end edge of the rear end portion 413 and defining the notch 415, and a non-antioxidation-treated surface portion 414*b* located in the notch 415 and formed by a free end surface of the connecting arm portion 416. In this embodiment, the metal casing 4 is made from copper or a copper alloy, and is formed by stamping a metal plate and removing a strip 8. Before the strip 8 is removed, the metal casing 4 is connected to the strip 8 through the connecting arm portion 416. After antioxidation surface treatment is performed, the connecting arm portion 416 is disconnected from the strip 8 to remove the strip 8. Thus, the non-antioxidation-treated surface portion 414*b* at the free end surface of the connecting arm portion 416 is a surface region formed by removing the strip 8 and not subjected to antioxidation treatment. The connecting arm portion 416 extends backward from the rear end portion 413 with a tapered width toward the central shaft C1, so as to form an upper surface portion 416*a* inclined toward the central shaft C1 from the rear end portion 413 to the non-antioxidation-treated surface portion 414*b*.

Please refer to FIG. 3 to FIG. 5 again. The insulation body 5 is disposed at the accommodation space 43, and includes a front end surface 51 at the front end, a rear end surface 52 at a rear end, a positioning hole 53 running through the insulation body 5 along the central shaft C1, a port 54 formed on the front end surface 51, and an insertion slot 55 recessed from the rear end surface 52 toward the front end surface 51 along the central shaft C1 and in communication with the positioning hole 53, and a wall covering portion 56 adjacent to the insertion slot 55. The rear end surface 52 is cut to be flush with the main surface portion 414*a* of the rear housing surface 414. The cross section of the positioning hole 53 is substantially square in this embodiment. The port 54 is square and communicates with the positioning hole 53.

Figure 8:
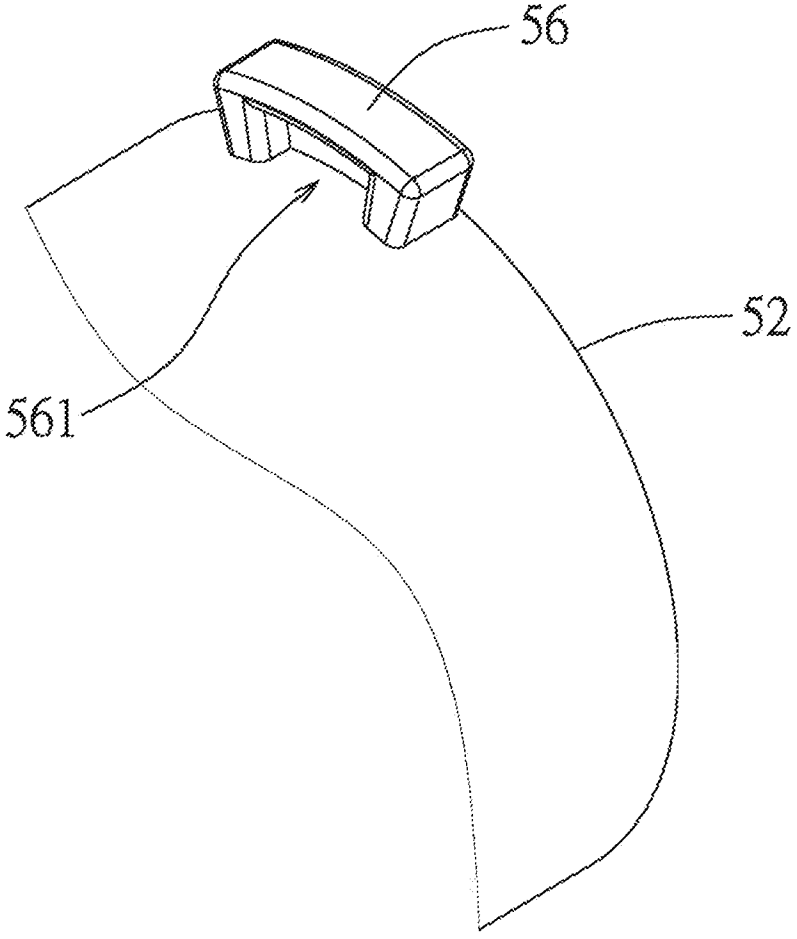
FIG. 8 is a partial enlarged view of FIG. 4.
Figure 9:
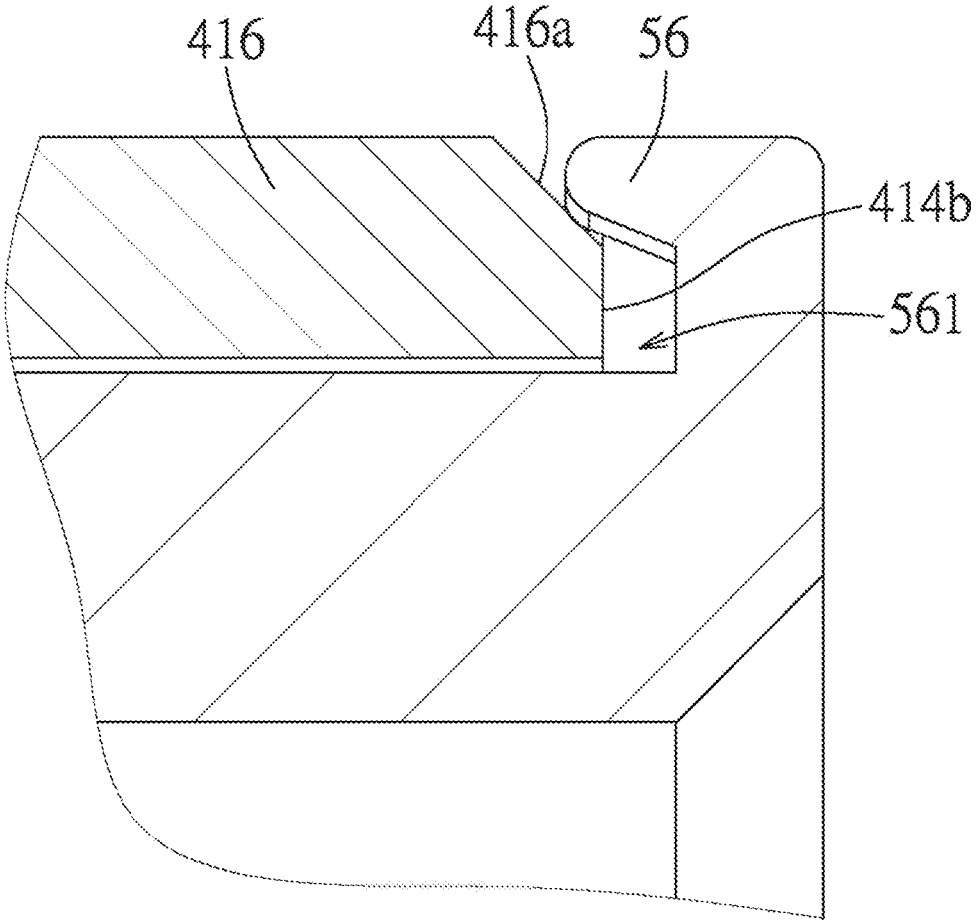
FIG. 9 is a partial enlarged view of FIG. 5.

The wall covering portion 56 extends radially from a position near the rear end surface 52 to cover the non-antioxidation-treated surface portion 414*b*. In this embodiment, the wall covering portion 56 is flush with the rear end surface 52 and extends into the notch 415 of the metal casing 4. The contour of the wall covering portion 56 matches the contour of the notch 415, so that the wall covering portion 56 can serve as an alignment reference for mounting the insulation body 5 in the metal casing 4, prevents the insulation body 5 from rotating relative to the metal casing 4, and covers the non-antioxidation-treated surface portion 414*b* at the end of the connecting arm portion 416. Please refer to FIG. 6, FIG. 8, and FIG. 9; specifically, the wall covering portion 56 has a receiving cavity 561 formed in a surface on the same side as the front end surface 51 so as to accommodate the connecting arm portion 416. That is, the opening of the receiving cavity 561 faces the front side. When the insulation body 5 is assembled with the metal casing 4, the upper surface portion 416*a* of the connecting arm portion 416 abuts the wall covering portion 56, and the non-antioxidation-treated surface portion 414*b* located at the free end surface of the connecting arm portion 416 is completely concealed in the receiving cavity 561 without being exposed, so that the non-antioxidation-treated surface portion 414*b* does not need to be additionally subjected to antioxidation treatment, and even if the non-antioxidation-treated surface portion is oxidized and a patina is formed, the patina would be hidden. The aesthetic appearance would not be affected, thereby reducing process steps and saving manufacturing costs and manufacturing time.

The central terminal 6 passes through the positioning hole 53 of the insulation body 5, and includes a central joint portion 61, a first contact end portion 62, and a second contact end portion 63. The central joint portion 61 has a square cross section so as to fit in the positioning hole 53 and pass through the port 54, and so as to be fixed in the insulation body 5 without rotating relative to the insulation body 5. The first contact end portion 62 extends forward from the front end of the central joint portion 61, and is adjacent to the contact arms 42. The second contact end portion 63 extends backward from the rear end of the central joint portion 61 and is located at the insertion slot 55.

When the coaxial connector 3 is assembled, the central terminal 6 and the insulation body 5 are assembled first, and the insulation body 5 is assembled with the metal casing 4. When the insulation body 5 and the metal casing 4 are assembled, the connecting arm portion 416 and the receiving cavity 561 can be used for guiding and alignment, so as to facilitate assembly.

In a variant embodiment, the housing 41 may not have the connecting arm portion 416; in other words, the connecting arm portion 416 can be cut off together with the strip 8, leaving only the notch 415. In this manner, the non-antioxidation-treated surface portion 414*b* is also located in the notch 415, and the wall covering portion 56 may not have the receiving cavity 561; in other words, the wall covering portion 56 can completely cover the non-antioxidation-treated surface portion 415 when engaging with the notch 415. In addition, in another variant embodiment, the housing 41 does not have the notch 415 and the connecting arm portion 416, so that the non-antioxidation-treated surface portion 414*b* and the main surface portion 414*a* are a continuous integral surface. That is, the rear housing surface 414 is a continuous annular surface, and the non-antioxidation-treated surface portion 414*b* is a partial region of the annular surface. The insulation body 5 can be correspondingly adjusted such that the rear end surface 52 protrudes outward along the central shaft C1 relative to the housing 41. The wall covering portion 56 covers at least the non-antioxidation-treated surface portion 414*b*, or completely covers the rear housing surface 414, and the receiving cavity 561 may be absent in the wall covering portion 56.

Figure 10:
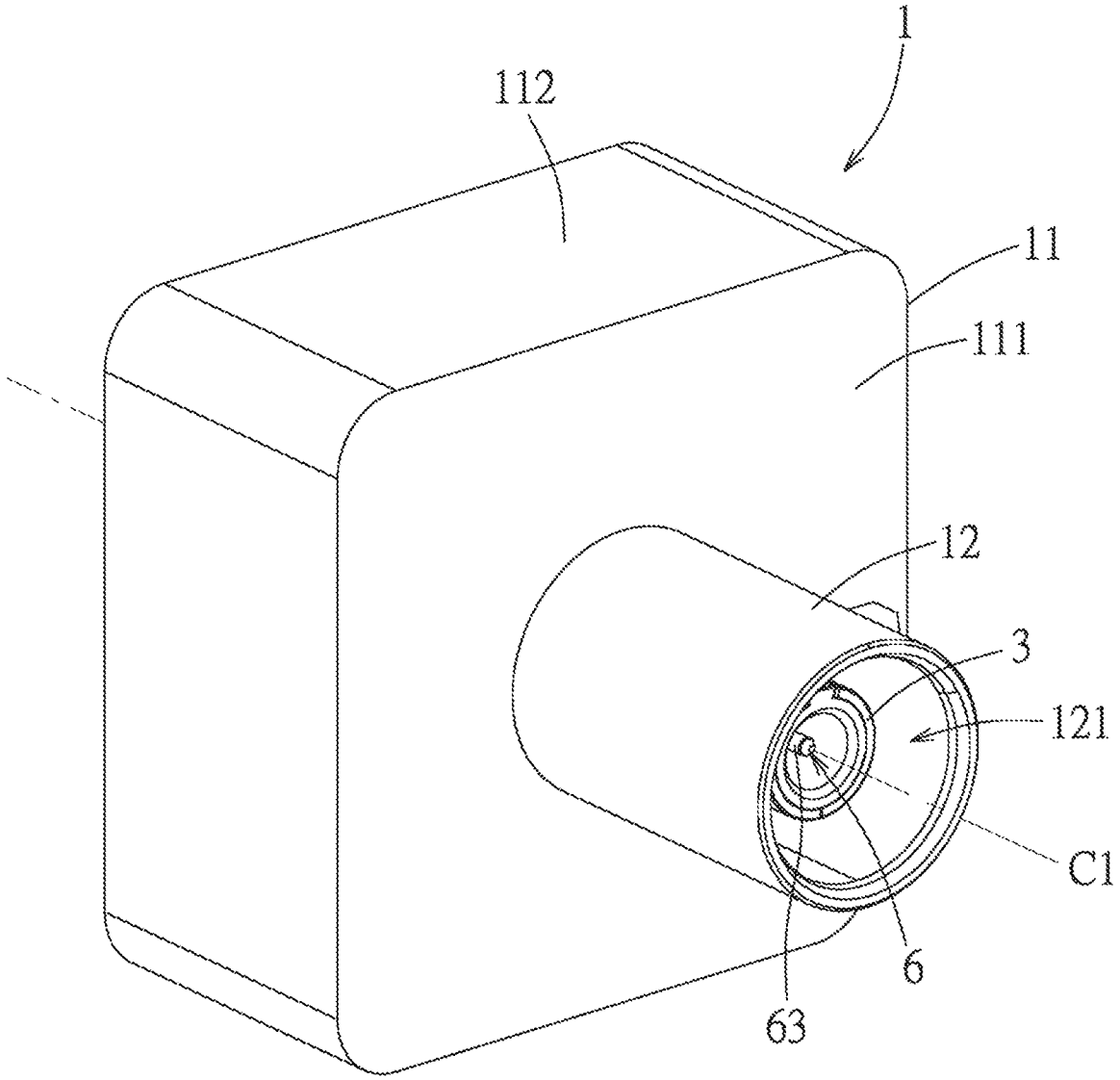
FIG. 10 is a perspective view of the embodiment disposed on an electronic device.
Figure 11:
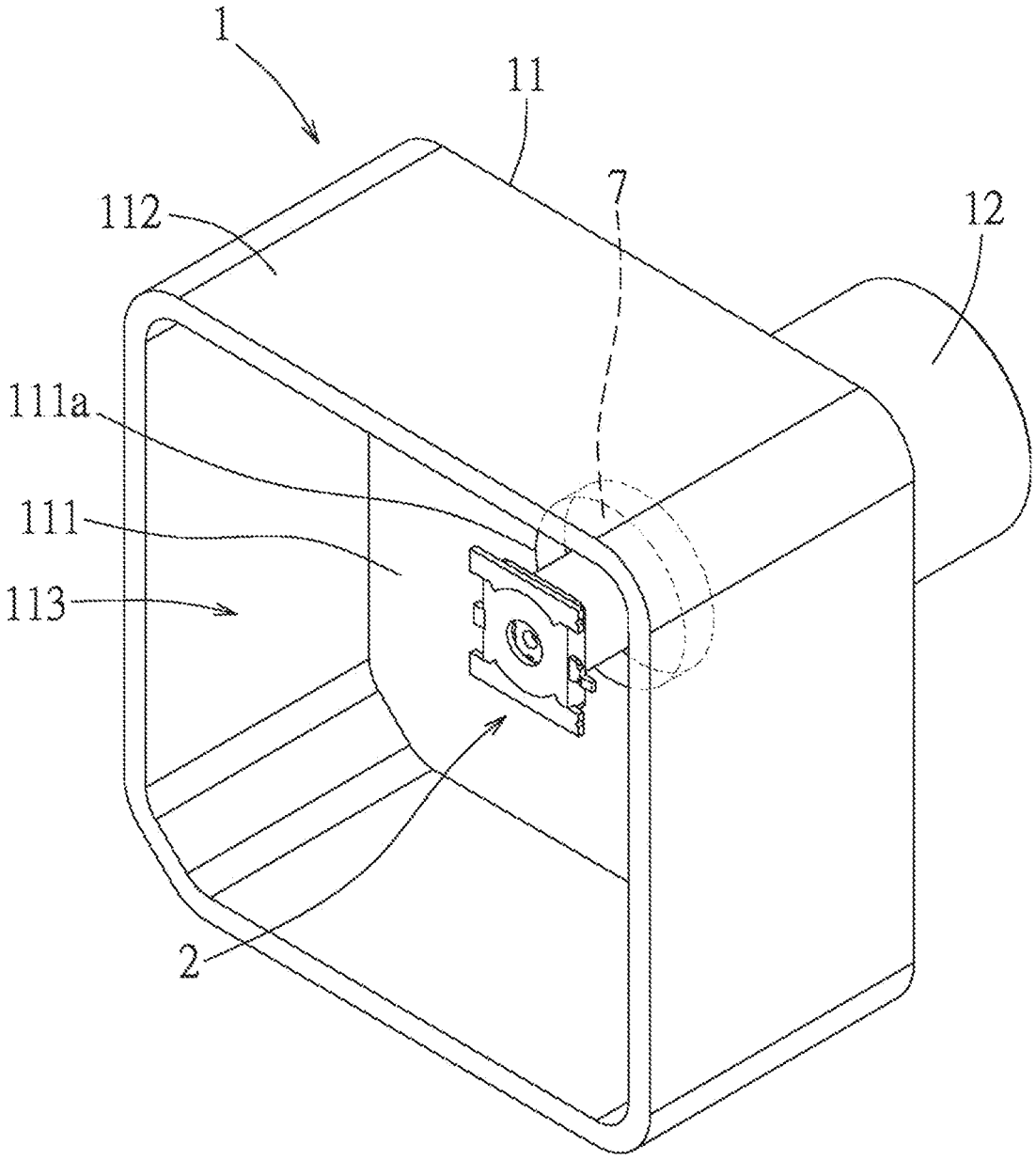
FIG. 11 is a perspective view of FIG. 10 from another angle.

Please refer to FIG. 10 and FIG. 11. The coaxial connector 3 is suitable for use in an electronic device, such as a vehicle navigation device, a vehicle audio, a driving recorder, a vehicle control panel, and other vehicular electronic devices, and supports vehicular FAKRA standard connection. In this embodiment, the electronic device includes a casing 1 and an electrical connector 2. The casing 1 is a rear portion of the whole electronic device, and a front portion (not shown) of the whole electronic device can be a lens module of a driving recorder, a panel module of a vehicle control panel, a display module of a vehicle navigation device, and the like; the present utility model is not limited thereto. The casing 1 includes a base 11 and a seat 12 extending backward from a surface of the base 11 and along the central shaft C1. The base 11 has a substantially square base wall 111 and a surrounding wall 112 extending forward from the periphery of the base wall 111. The base wall 111 has a circular through hole 111*a*. The base wall 111 and the surrounding wall 112 collectively define a receiving space 113 communicating with the through hole 111*a*. The base 12 has a cylindrical shape, is connected to the base wall 111, and defines a docking cavity 121 communicating with the through hole 111*a*. The docking cavity 121 is adapted to dispose the coaxial connector 3, and the coaxial connector 3 is closely positioned on the central shaft C1 by injecting a sealing material 7. The docking cavity 121 is adapted to enable a terminal of a cable (not shown) to extend forward thereto, so that the docking cavity 121 is mechanically connected to the base 12 and electrically connected to the second contact end portion 63 of the central terminal 6 of the coaxial connector 3 in accordance with FAKRA standards.

Figure 12:
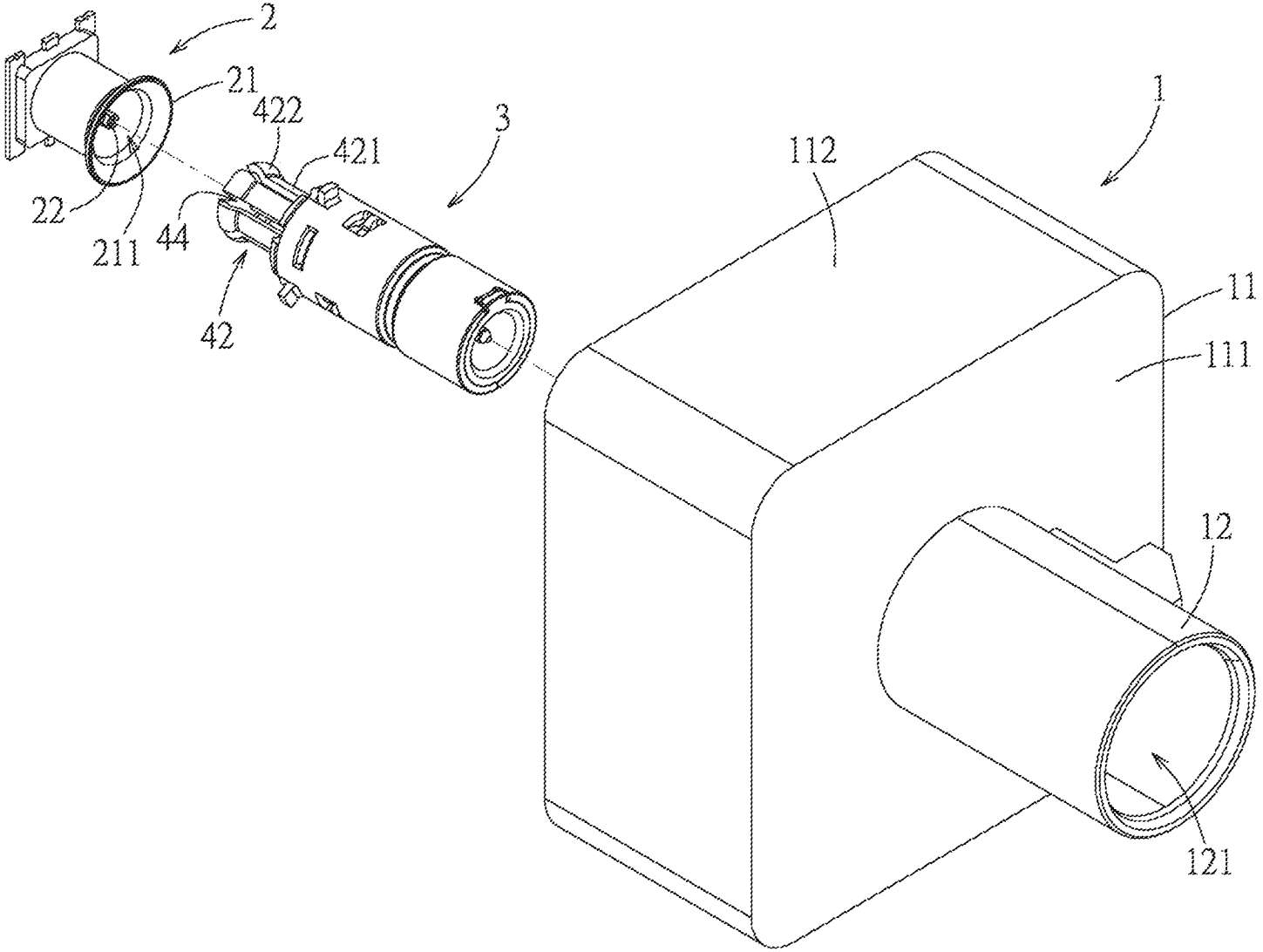
FIG. 12 is an exploded perspective view of the electronic device.
Figure 13:
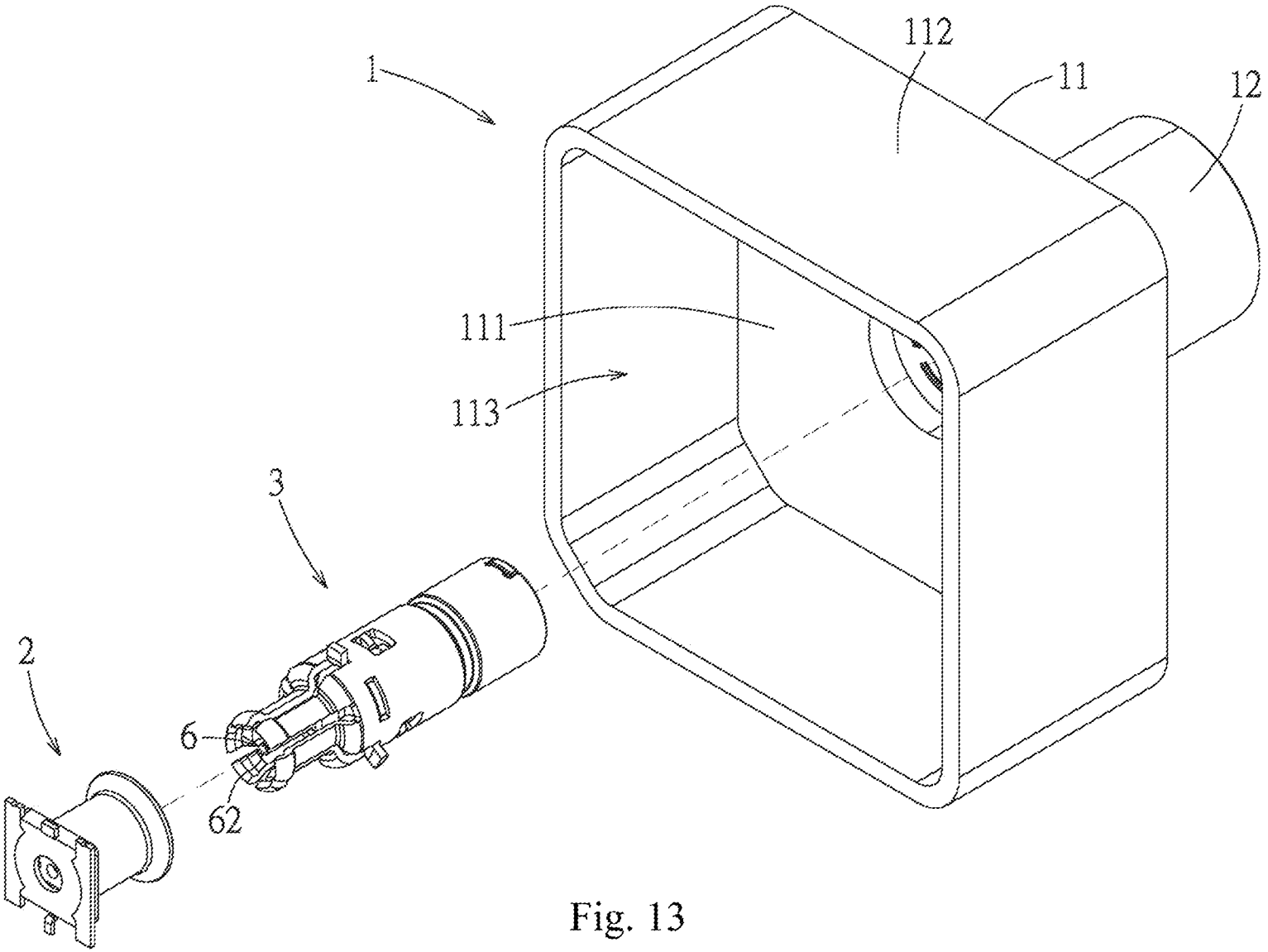
FIG. 13 is an exploded perspective view of FIG. 12 from another angle.

Please refer to FIG. 12 and FIG. 13. The electrical connector 2 is disposed on a circuit board (not shown) in the electronic device, and is adapted to be mechanically and electrically connected to the coaxial connector 3. The electrical connector 2 includes an outer conductor 21 and an inner terminal 22. The outer conductor 21 has a cylindrical shape and defines a joint space 211, and a rear end edge of the outer conductor 21 expands outward, such that the joint space 211 expands backward. One end of the coaxial connector 3 can thus be smoothly inserted into the joint space 211 during assembly of the electrical connector 2. Specifically, the contact arms 42 of the coaxial connector 3 are adapted to extend into the joint space 211 of the electrical connector 2. In addition, during insertion, the design of the slits 44 causes the extension portions 421 of the contact arms 42 to be elastically inclined and deformed toward the central shaft C1 to conform to the shape of the outer conductor 21, and causes the bent portions 422 of the contact arms 42 to abut an inner wall surface of the outer conductor 21, so that the metal casing 4 is electrically connected to the electrical connector 2 so as to ground the coaxial connector 3. The inner terminal 22 is adapted to be electrically connected to the first contact end portion 62 of the central terminal 6 of the coaxial connector 3.

In summary, in the coaxial connector 3 of the present utility model, the wall covering portion 56 formed on the insulation body 5 and near the rear end surface 52 covers the non-antioxidation-treated surface portion 414*b* formed when the metal casing 4 is separated from the strip 8, such that the non-antioxidation-treated surface portion 414*b* does not need to be subjected to additional antioxidation treatment. Even if the non-antioxidation-treated surface portion 414*b* is oxidized and a patina is formed, the patina would be hidden, and the aesthetic appearance would not be affected. Therefore, process steps are reduced, thereby saving manufacturing costs and time.

The above is merely the embodiments of the present utility model, and the scope of the implementation of the present utility model is not limited thereto. Simple equivalent changes and modifications made according to the claims and specification of the present utility model shall fall within the scope of the patent of the present utility model.

The invention claimed is:

1. A coaxial connector, having a central axis and comprising:

a metal casing, comprising a housing surrounding the central shaft to define an accommodation space, and a plurality of contact arms connected to the housing, the housing having a front housing surface and a rear housing surface, the rear housing surface having a non-antioxidation-treated surface portion, and the plurality of contact arms being connected to the front housing surface and surrounding the central shaft in a manner spaced apart from each other;

an insulation body, disposed in the accommodation space and surrounding the central axis to define a positioning hole, the insulation body comprising a front end surface provided proximate to the front housing surface and a rear end surface provided proximate to the rear housing surface whereby the insulation body substantially spans an entire length of the accommodating space along the central axis, an insertion slot recessed from the rear end surface toward the front end surface along the central axis and in communication with the positioning hole, and a wall covering portion extending radially from a position near the rear end surface to cover the non-antioxidation-treated surface portion; and a central terminal, passing through the positioning hole and comprising a first contact end portion adjacent to the plurality of contact arms and a second contact end portion located at the insertion slot.

2. The coaxial connector according to claim 1, wherein the non-antioxidation-treated surface portion is formed by removing a strip.

3. The coaxial connector according to claim 1, wherein the housing further comprises a notch; the non-antioxidation-treated surface portion is located in the notch; the wall covering portion extends into the notch and covers the non-antioxidation-treated surface portion.

4. The coaxial connector according to claim 3, wherein the contour of the wall covering portion matches the contour of the notch.

5. The coaxial connector according to claim 3, wherein the housing further comprises a connecting arm portion extending backward with a tapered width located at the notch; the non-antioxidation-treated surface portion is a free end surface of the connecting arm portion; the wall covering portion forms a receiving cavity for the connecting arm portion to enter, causing the non-antioxidation-treated surface portion to be located in the receiving cavity.

6. The coaxial connector according to claim 5, wherein the receiving cavity is formed on the same side as the wall covering portion and the front end surface.

7. The coaxial connector according to claim 5, wherein the connecting arm portion is provided with an upper surface portion inclined toward the central axis and adapted to abut the wall covering portion.

8. The coaxial connector according to claim 1, wherein the wall covering portion is flush with the rear end surface.

9. The coaxial connector according to claim 1, wherein each of the contact arms has an extension portion extending forward from the front housing surface and a bent portion extending forward from the extension portion.

10. The coaxial connector according to claim 1, wherein the metal casing is made from copper or a copper alloy.

11. A coaxial connector, having a central axis and comprising:

a metal casing, comprising a housing surrounding the central shaft to define an accommodation space, and a plurality of contact arms connected to the housing, the housing having a front housing surface and a rear housing surface, the rear housing surface having a non-antioxidation-treated surface portion, and the plurality of contact arms being connected to the front housing surface and surrounding the central shaft in a manner spaced apart from each other;

an insulation body, disposed in the accommodation space and surrounding the central axis to define a positioning hole, the insulation body comprising a front end surface, an insertion slot recessed from the rear end surface toward the front end surface along the central axis and in communication with the positioning hole, and a wall covering portion extending radially from a position near the rear end surface to cover the non-antioxidation-treated surface portion; and a central terminal, passing through the positioning hole and comprising a first contact end portion adjacent to the plurality of contact arms and a second contact end portion located at the insertion slot, wherein the housing further comprises a notch, wherein the non-antioxidation-treated surface portion is located in the notch, wherein the wall covering portion extends into the notch and covers the non-antioxidation-treated surface portion, and wherein the contour of the wall covering portion matches the contour of the notch.

12. The coaxial connector according to claim 11, wherein the housing further comprises a connecting arm portion extending backward with a tapered width located at the notch; the non-antioxidation-treated surface portion is a free end surface of the connecting arm portion; the wall covering portion forms a receiving cavity for the connecting arm portion to enter, causing the non-antioxidation-treated surface portion to be located in the receiving cavity.

13. The coaxial connector according to claim 12, wherein the receiving cavity is formed on the same side as the wall covering portion and the front end surface.

14. The coaxial connector according to claim 12, wherein the connecting arm portion is provided with an upper surface portion inclined toward the central axis and adapted to abut the wall covering portion.

15. The coaxial connector according to claim 11, wherein the non-antioxidation-treated surface portion is formed by removing a strip.

16. The coaxial connector according to claim 11, wherein the wall covering portion is flush with the rear end surface.

17. The coaxial connector according to claim 11, wherein each of the contact anus has an extension portion extending forward from the front housing surface and a bent portion extending forward from the extension portion.

18. The coaxial connector according to claim 11, wherein the metal casing is made from copper or a copper alloy.

* * * * *